US011396764B2

(12) United States Patent
Blount et al.

(10) Patent No.: US 11,396,764 B2
(45) Date of Patent: Jul. 26, 2022

(54) DOOR HANDLE ASSEMBLY

(71) Applicant: BENTLEY MOTORS LIMITED, Crewe (GB)

(72) Inventors: John Blount, Crewe (GB); Russell Beeston, Market Drayton (GB)

(73) Assignee: BENTLEY MOTORS LIMITED, Crewe (GB)

( * ) Notice: Subject to any disclaimer, the term of this patent is extended or adjusted under 35 U.S.C. 154(b) by 709 days.

(21) Appl. No.: 16/083,489

(22) PCT Filed: Mar. 8, 2017

(86) PCT No.: PCT/GB2017/050616
§ 371 (c)(1),
(2) Date: Sep. 7, 2018

(87) PCT Pub. No.: WO2017/153746
PCT Pub. Date: Sep. 14, 2017

(65) Prior Publication Data

US 2019/0078360 A1 Mar. 14, 2019

(30) Foreign Application Priority Data

Mar. 10, 2016 (GB) ..... 1604137

(51) Int. Cl.
*E05B 85/10* (2014.01)
*E05B 81/76* (2014.01)
*E05B 17/10* (2006.01)

(52) U.S. Cl.
CPC ..... *E05B 85/103* (2013.01); *E05B 81/76* (2013.01); *E05B 17/10* (2013.01)

(58) Field of Classification Search
CPC ..... E05B 1/0084; E05B 17/10; E05B 81/76; E05B 85/103; E05B 81/64; E05B 5/006; E05B 85/107; Y10S 292/31
See application file for complete search history.

(56) References Cited

U.S. PATENT DOCUMENTS 4,895,403 A 1/1990 Osenkowski
6,062,614 A * 5/2000 Petzold ..... E05B 85/14 292/336.3

(Continued)

FOREIGN PATENT DOCUMENTS

DE 3700135 A1 * 7/1988
DE 3835265 A1 4/1990

(Continued)

OTHER PUBLICATIONS

"Transparent," Oxford English and Spanish Dictionary, Lexico.com (Year: 2021).*

(Continued)

*Primary Examiner* — Kristina R Fulton
*Assistant Examiner* — Emily G. Brown
(74) *Attorney, Agent, or Firm* — Schwabe Williamson & Wyatt, P.C.

(57) ABSTRACT

A door handle assembly is provided in the door of an automobile. The assembly includes an aperture in the outer skin of the door and a cover plate which closes off the aperture. The cover plate is retractable into a pocket behind the aperture, to open the aperture and allow a user to insert his/her fingers into the aperture. The user may then grab a latch release handle which is provided on the inner surface of the skin of the door, which senses the user's touch and releases a door latch, so that the door can be pulled open.

19 Claims, 5 Drawing Sheets

(56) References Cited

U.S. PATENT DOCUMENTS

| | | | | |
|---|---|---|---|---|
| 6,209,933 | B1 * | 4/2001 | Ang | E05B 17/10 292/336.3 |
| 7,442,892 | B2 * | 10/2008 | Ishiguro | E05B 81/76 200/302.2 |
| 7,791,218 | B2 | 9/2010 | Mekky | |
| 8,786,401 | B2 * | 7/2014 | Sobecki | E05B 17/10 340/5.72 |
| 2004/0135380 | A1 | 7/2004 | Bruderick | |
| 2004/0173446 | A1 * | 9/2004 | Plana-Bague | H01H 13/023 200/314 |
| 2004/0177478 | A1 * | 9/2004 | Louvel | E05B 81/78 16/430 |
| 2006/0119113 | A1 * | 6/2006 | Ishiguro | E05B 81/76 292/336.3 |
| 2008/0163555 | A1 | 7/2008 | Thomas | |
| 2009/0058132 | A1 * | 3/2009 | Browne | B60R 11/02 296/181.7 |
| 2011/0148575 | A1 | 6/2011 | Sobecki | |
| 2012/0119524 | A1 | 5/2012 | Bingle | |
| 2012/0205924 | A1 | 8/2012 | Muller | |
| 2012/0205925 | A1 | 8/2012 | Muller | |
| 2012/0228886 | A1 | 9/2012 | Muller | |
| 2012/0247161 | A1 | 10/2012 | Muller | |
| 2013/0127185 | A1 | 5/2013 | Lang | |
| 2013/0170241 | A1 * | 7/2013 | Lesueur | E05B 77/42 70/91 |
| 2013/0241215 | A1 | 9/2013 | Halliwell | |
| 2014/0000167 | A1 | 1/2014 | Patel | |
| 2014/0047773 | A1 | 2/2014 | Johnsrud | |
| 2014/0265372 | A1 | 9/2014 | Smart | |
| 2014/0300115 | A1 * | 10/2014 | Vasi | E05B 85/103 292/336.3 |
| 2015/0315812 | A1 * | 11/2015 | Vasi | E05B 81/08 292/336.3 |
| 2016/0010369 | A1 * | 1/2016 | Specht | E05B 85/16 292/336.3 |
| 2016/0208523 | A1 * | 7/2016 | Bingle | E05B 85/103 |

FOREIGN PATENT DOCUMENTS

| | | | | |
|---|---|---|---|---|
| DE | 19731325 | A1 | 1/1999 | |
| DE | 19847212 | A1 | 4/2000 | |
| DE | 10134993 | A1 | 2/2003 | |
| DE | 10309821 | A1 | 9/2004 | |
| DE | 202011104328 | U1 | 11/2011 | |
| DE | 102013012489 | A1 | 1/2015 | |
| EP | 1932984 | A1 | 6/2008 | |
| EP | 2808467 | A1 | 12/2014 | |
| GB | 576224 | | 4/1944 | |
| GB | 2506350 | A * | 4/2014 | E05B 81/76 |
| KR | 100931160 | B1 * | 12/2009 | |
| WO | WO2014049025 | A1 | 4/2014 | |
| WO | WO2015148788 | A1 | 10/2015 | |

OTHER PUBLICATIONS

"Translucent," Oxford English and Spanish Dictionary, Lexico.com (Year: 2021).*

"Slide," Oxford English and Spanish Dictionary, Lexico.com (Year: 2021).*

* cited by examiner

DOOR HANDLE ASSEMBLY

CROSS REFERENCE TO RELATED APPLICATIONS

The present application is a national phase entry under 35 U.S.C. § 371 of International Application No. PCT/GB2017/050616, filed Mar. 8, 2017, entitled "DOOR HANDLE ASSEMBLY," which designated, among the various States, the United States of America, and which claims priority to GB 1604137.8 filed Mar. 10, 2016, both of which are hereby incorporated by reference.

TECHNICAL FIELD OF THE INVENTION

The present invention relates to a door handle assembly; in particular a door handle assembly for a vehicle, such as an automobile, and to a door comprising a door handle assembly.

BACKGROUND TO THE INVENTION

For aesthetic and aerodynamic reasons, certain automotive manufacturers have created door handles which when not in use are flush with the outer surface of the door that they open. One such example can be found on the FIAT® Barchetta type 183 automobile, which is provided with a door handle assembly having a handle which is flush with the outer surface of the door, and a mechanical button which when pressed causes the handle to pivot outward to a position from which it can be pulled to unlatch the door.

More recently, the TESLA® Model S automobile has been provided with a door handle assembly, in which the handle is flush with the outer surface of the door, but in response to proximity of the door key to a sensor, they are automatically extended (by a motor), so that it can be grasped by the user and pulled to open the door.

Various other publications disclose flush door handles, for example, an arrangement is proposed in U.S. Pat. No. 4,895,403, in which a user can rotate a handle inwards about a first axis into a recess, then pull on the handle, such that it rotates outwards about a second axis to unlatch and open the door.

US2004/0135380 discloses another arrangement, in which, when the door is closed, the handle is arranged on a horizontal upper surface. To open the door, the handle can be rotated inward and downward, to a vertical orientation, then pulled in an outward direction to open the door.

This arrangement is unsuitable for most vehicle doors, as most doors are largely arranged in the vertical plane, without any horizontal surfaces suitable for mounting the handle. However, the motion, with no parts extending out of the recess in use is attractive and it is desirable to achieve a similar motion, but to provide a door handle assembly that can be used on a substantially vertical surface, as found on conventional automobile doors.

SUMMARY OF THE INVENTION

According to a first aspect of the present invention there is provided a door handle assembly comprising a door panel having an outer surface and an inner surface, an aperture being provided in the door panel and a cover plate being arranged to close the aperture and actuable to retract inwardly; wherein a latch release handle is provided on the inner surface of the door panel.

The inward retraction allows a user to introduce his/her fingers into the aperture. With the cover plate retracted, in use, a user may pull the latch release handle to release a latch and open the door.

The provision of a latch release handle on the inner surface of the door panel allows for the use of a mechanism similar in appearance to that of US2004/0135380, with no parts which extend outward in use, but which can be used on a substantially vertical door panel since the door handle is formed as a separate component from the cover plate, on the inner surface of the door panel.

Providing the latch release handle on the inner surface of the door panel also allows a robust connection between the handle and the door as compared to use of a pivoting cover plate as a handle.

The latch release handle may be provided above the aperture. This is beneficial in reducing the likelihood of water ingress. Alternatively, the latch release handle may be provided to one side of the aperture. This puts the handle in an ergonomically optimal position for pivoting the door open about a vertical hinge.

The latch release handle may be provided with a textured surface. For example, formations, such as knurling, or indentations arranged to match to a user's fingers may be provided on the handle. This will assist in a passenger's understanding of how to operate a somewhat unconventional style of handle.

The latch release handle may be formed of metal. It may have a depth of at least 10 mm, for example at least 20 mm, such as about 25 mm, it may have a height in the range of 15 mm to 40 mm. Its width may be substantially equal to the width of the aperture. A latch release handle in metal, and having the dimensions referred to, especially a substantial depth, gives the feel of a conventional handle, aiding the passenger's understanding and providing an ergonomic, expensive feel to the handle assembly.

The door panel may be the outer skin of the door, which forms the outer surface of a vehicle. Alternatively, the door panel may be a separate panel attached (e.g. by welding) to the outer skin of the door.

The latch release handle may be provided with an electronic switch or sensor, operable, when pulled, to transmit a door release signal.

The electronic switch or sensor may comprise a microswitch, or a touch sensitive, e.g. capacitive sensor. The door release signal may be transmitted to an E-latch, to unlatch the door. E-latches are widely available, for example from Kiekert AG and described for example in U.S. Pat. No. 7,791,218 B2.

The latch release handle may (additionally or alternatively) be provided with a mechanical latch release system. For example, the mechanical latch release system may comprise a Bowden cable attached to the latch release handle, and biasing means, such as a spring biasing the handle inwards, such that when pulled outward against the bias, the cable is tightened or loosened and thereby opens a mechanical door latch.

The Bowden cable may provide a mechanical signal to operate an E-latch, or may open a conventional mechanical latch.

The door handle assembly may comprise a motor, operable to retract the cover plate inwardly to open the aperture. The motor may also be operable to return the cover to the closed position.

The cover plate may be biased, e.g. with a spring, towards the closed position.

The bias and/or the resistance of the motor may be selected such that a user can overcome the force and push the cover plate inwards. For example, the force against pushing the cover plate may be less than 20 Newtons.

The assembly may be operable to retract the cover plate in response to an electronic "open" signal. The "open" signal may be provided by a remote key, keyless entry by proximity sensing, by a sensor (e.g. a fingerprint sensor) provided on, or near the cover plate, by pressing an interior unlock button, and/or by operating an interior door handle. The assembly may be provided with a signal processor to control the reaction to the signal, or signal processing may be handled for example by an electronic control system (ECU), such as a door control unit (DCU), or central control module.

The cover plate may be arranged to fold inwardly.

The cover plate may be arranged to slide inwardly.

The cover plate may be arranged to slide upwardly.

The cover plate may be arranged to fold inwardly, then slide inwardly and upwardly. This movement gives maximum hand clearance and comfort, minimising the possibility of the fingers contacting the cover plate.

The cover plate may be carried by guide rails, and/or provided with a rack, with a motor attached to a pinion to retract the cover plate, and/or a Bowden cable with a motor attached to retract the cover plate.

The cover plate may be arranged to be substantially flush with the door panel in the closed position. The cover plate may substantially fill the aperture in the closed position, e.g. there may be a gap of no more than 3 mm, preferably no more than 1 mm, between the periphery of the cover plate and the periphery of the aperture.

The gap between the periphery of the cover plate and the periphery of the aperture may be at least 1 mm, for example between 1 mm and 3 mm. This allows light from behind the cover plate to be seen around it, even when the cover plate is closed. Accordingly, a welcome sequence can be provided prior to retraction of the cover plate (e.g. in response to unlocking the car via an electronic remote, or sensing proximity of the user).

The aperture may have a height of at least 40 mm, preferably at least 45 mm, such as 50 mm. It may have a width of at least 10 mm, for example 20 mm. This allows a good clearance for fingers in the aperture to operate the latch release handle without contacting the exterior of the vehicle, or the retracted cover plate. This adds to the luxury operation and feel of the handle, which is difficult to attain in handles of this type.

A pocket may be formed behind the aperture, e.g. by a secondary panel. The provision of a pocket formed by a secondary panel prevents ingress of water into the interior of the door and is particularly preferred where the aperture is provided in the skin of the door.

A lock barrel may be provided in the pocket, e.g. in the secondary panel. This improves the clean appearance of the outer surface, whilst allowing fora manual override in the event of failure of the electronic open signal.

The lock barrel may be provided with a removeable cover, which may be formed of the same material and in the same colour as the surrounding (secondary) panel. This can avoid it being noticeable, spoiling the aesthetics, and can also reduce the prospect of thieves accessing the lock barrel.

One or more lamps may be provided to illuminate a region behind the aperture, e.g. the pocket.

The one or more lamps may be provided on the inner surface of the door panel, and may be provided above the lamp. Providing the lamp(s), at the front of the pocket, and at the top, allows for best coverage from the "puddle" lamp, when the cover plate is open.

The one or more lamps may be arranged to illuminate a gap between the cover plate and the aperture when the cover plate is in the closed position. The one or more lamps may be arranged to alter the colour of the illumination to customer choice or in response to lock status. For example green light may indicate that the door is unlocked, whereas red may indicate that the door is locked.

The latch release handle may be transparent/translucent. The latch release handle may be provided between the lamp and the pocket.

The pocket may comprise a decorative optionally illuminated surface. For example it could be back-lit and/or provided with a logo.

The aperture may be provided in a substantially vertical portion of the door panel.

The inward retraction may allow a user to introduce his/her fingers into the aperture and in use following inward retraction of the cover plate the latch release handle may be pullable to release a latch and open the door.

The invention extends to a door comprising a door handle assembly as set out above (optionally including any of the optional features) and to a vehicle, including an automobile comprising such a door.

A second aspect of the invention provides a method of operating a door handle according to the first aspect (optionally including any of the optional features) comprising retracting a cover plate inwardly in response to a signal so as to open the aperture and allow a user to introduce his/her fingers into the aperture; and releasing a latch in response to contact with the latch release handle.

The method may comprise retracting a cover plate inwardly and illuminating at least one lamp in response to the signal.

DETAILED DESCRIPTION OF THE INVENTION

In order that the invention may be more clearly understood an embodiment thereof will now be described, by way of example only, with reference to the accompanying drawings, of which:

Figure 1:
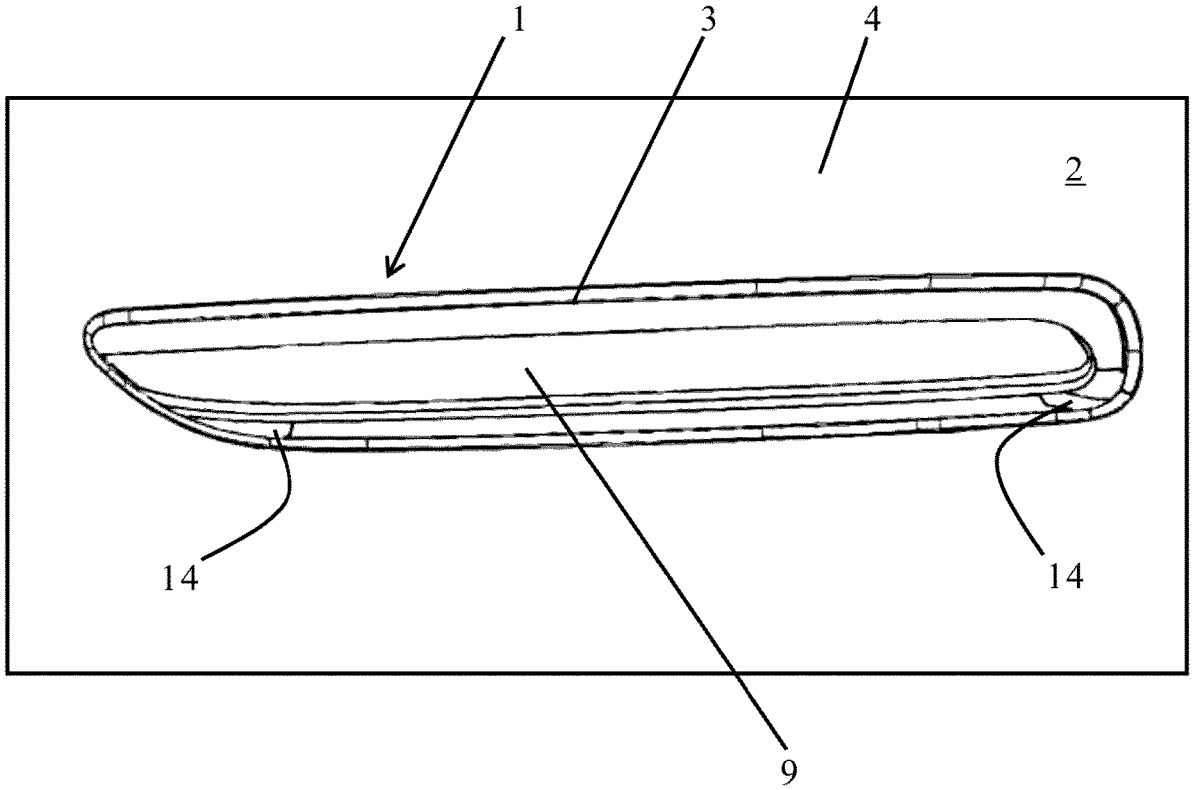
FIG. 1 shows a fragmentary side elevation of the door of an automobile including a door assembly according to the invention with the cover plate partially retracted.
Figure 2:
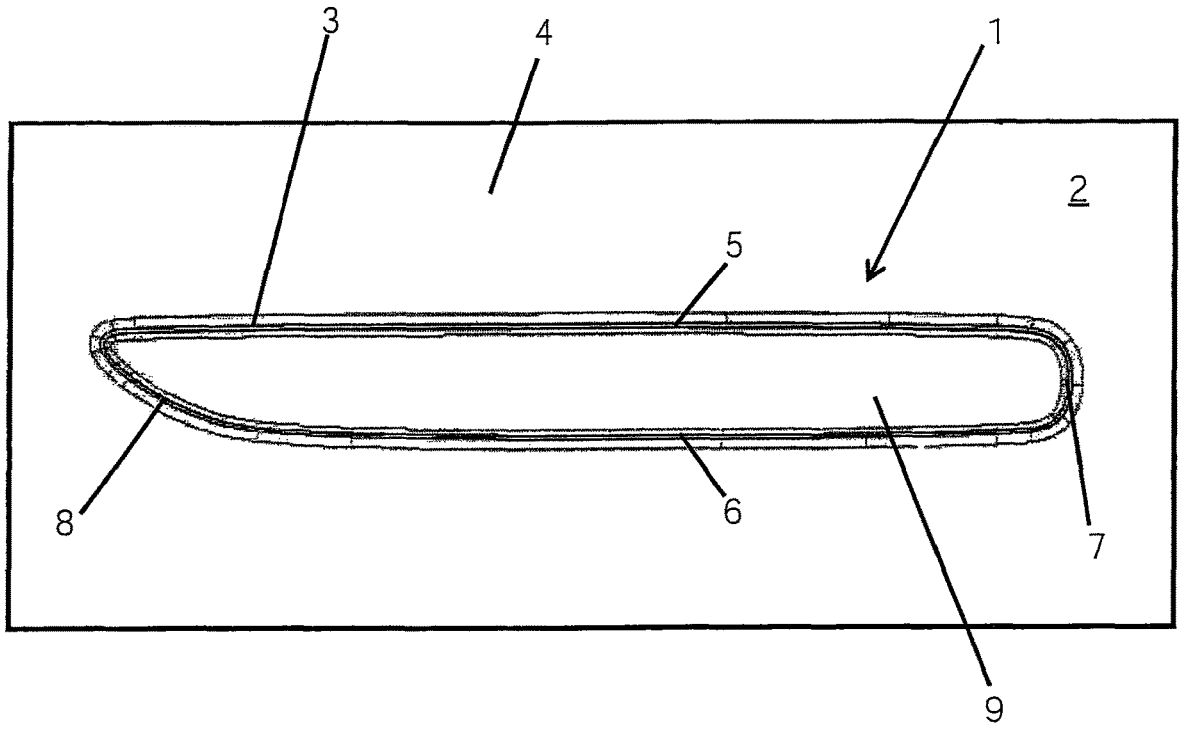
FIG. 2 shows a fragmentary side elevation of the door of FIG. 1 with the cover plate closed.
Figure 3:
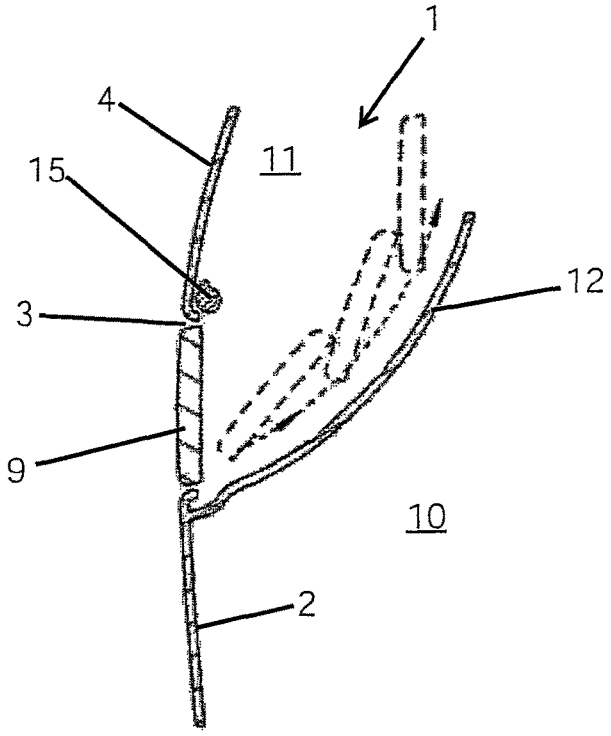
FIG. 3 shows a lateral cross sectional view of the door assembly of FIGS. 1 and 2 taken along the line B-B in FIG. 2.
Figure 4A:
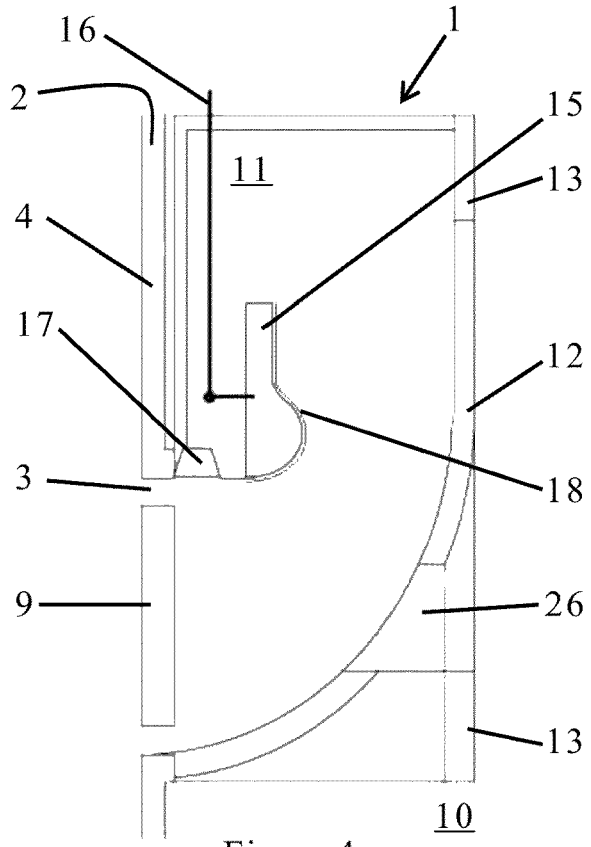
Figure 4B:
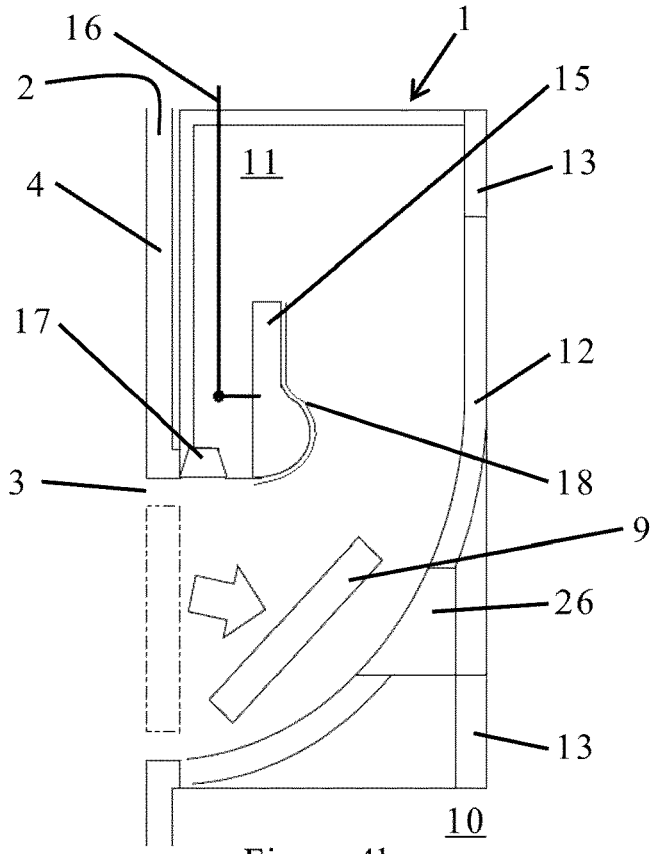
Figure 4C:
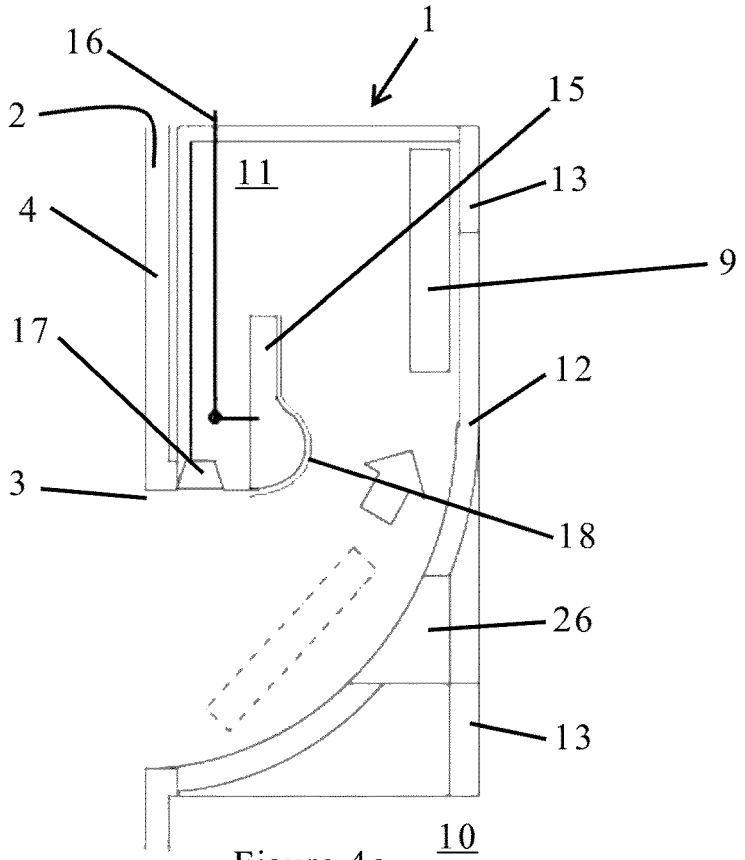
Figure 4D:
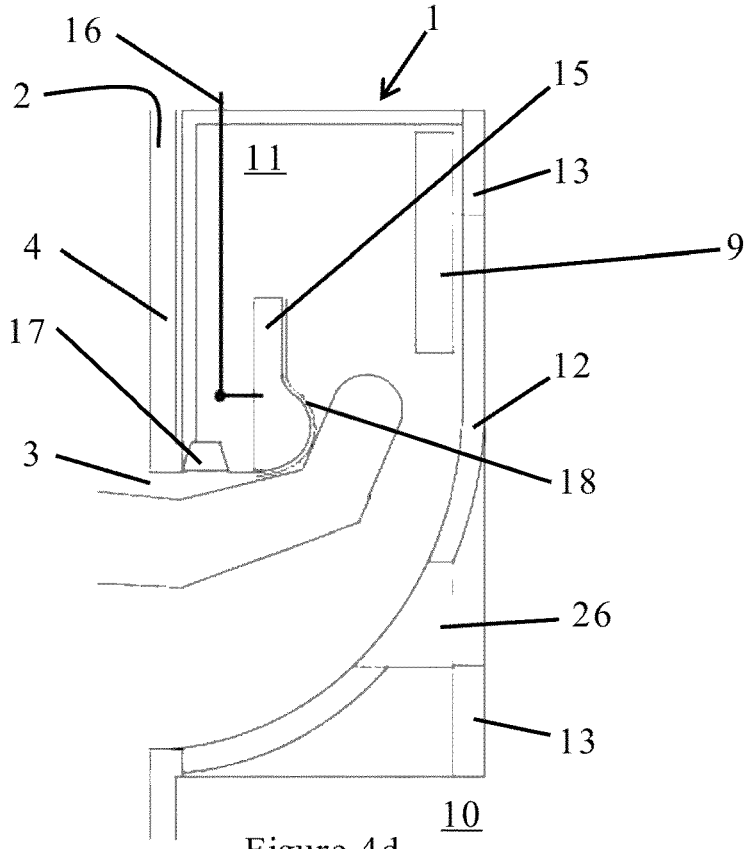
Figure 5:
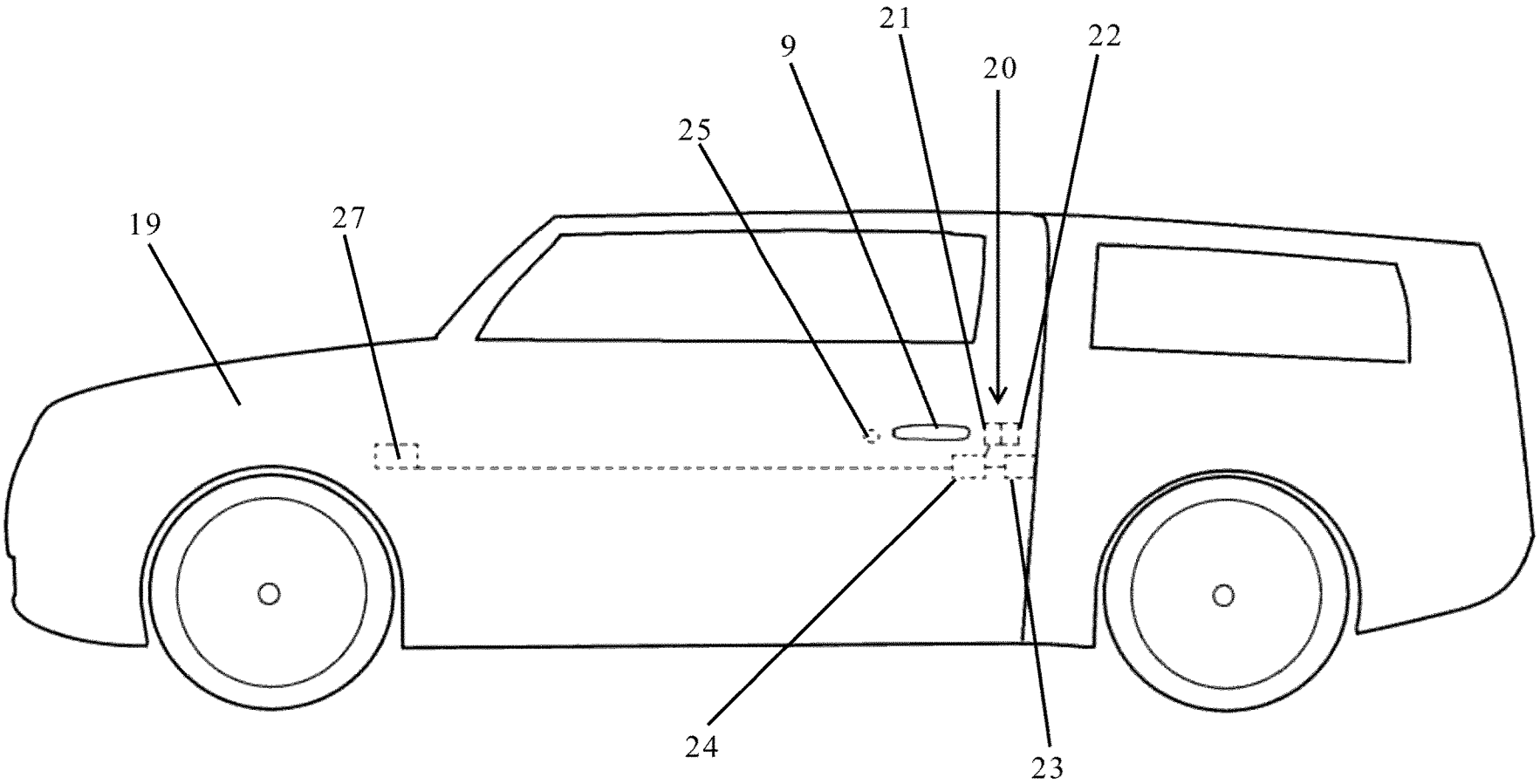

FIGS. 4*a-d* show diagrammatical cross sectional views of the door assembly of FIGS. 1 to 3; and FIG. 5 shows a schematic view of a vehicle incorporating the door assembly of FIGS. 1-4*d*.

Referring to the drawings, a door handle assembly 1 is provided in the door 2 of an automobile 19. The door handle assembly 1 includes an aperture 3 in the outer skin or outer door panel 4 of the door 2, which forms the outer surface of the automobile 19.

As is conventional, the outer skin 4 of the door 2 is substantially vertical, with its outer surface defining part of one side of the automobile 19; its inner surface defines one side of a cavity 10, between the outer skin 4 and an inner skin (not shown). In this embodiment, the aperture 3 is elongate and extends (in the vertical plane) substantially horizontally across the outer skin 4. It will be understood that it could extend substantially vertically, or indeed at an angle between the horizontal and the vertical.

The aperture 3 in this embodiment is substantially trapezoidal, with two long parallel edges 5, 6, a rear edge 7 which is perpendicular to the parallel edges 5, 6 and a forward edge 8 which extends downward and rearward from its foremost upper end. The corners are all curved. Obviously other shapes could be used.

A cover plate 9 is provided, which has an identical shape to the aperture 3, but is very slightly smaller, e.g. the length of the aperture 3 may be 200 mm and its height 50 mm and the cover plate 9 may have a length of 198 mm and a height of 48 mm.

The outer surface of the cover plate 9 is arranged to be flush with the outer surface of the outer skin 4 of the door 2 in a closed configuration and to thereby close the aperture 3, to produce a smooth aerodynamically efficient outer surface of the vehicle.

The door panel 4 and the cover plate 9 may be made of any suitable materials and finished as desired, for example, they may be formed in metal (e.g. steel or aluminium) or composites and painted.

The cover plate 9 is mounted so as to be retractable into the door cavity 10, more particularly into a pocket 11 formed within the door cavity 10 by a secondary panel 12 extending from the lower edge 6 of the aperture 2 into the cavity 10, inwardly and upwardly. As shown in FIGS. 4*a-c*, the secondary panel 12 is fastened within the door cavity 10 at a series of fixing points 13.

The reverse surface of the cover plate 9 is rotatably mounted (at the front and rear) to one end of a pair of supports 14 (FIG. 1) to allow the cover panel 9 to be retracted into the pocket 11. The opposite ends of the supports 14 are movably connected to a drive mechanism 20, in the form of a rack-and-pinion or Bowden cable & pulley 21 driven by a motor 22 (FIG. 5) so as to retract the cover plate 9 into the pocket 11 and thereby open the aperture in response to a signal, and return the cover plate 9 to the closed configuration.

A spring (not shown) can be provided as a resilient bias to urge the cover plate 9 towards the closed position.

The bias and the force of the motor are selected such that whilst urging the cover plate 9 towards the closed position, they can be overcome by a user to manually force the cover plate 9 to retract, should the motorised drive mechanism fail (e.g. due to an electrical fault).

As shown in FIGS. 4*a* to 4*d*, and by the phantom-lines in FIG. 3, the drive mechanism is arranged so as to initially fold the cover plate 9 downwards and inwards (FIG. 4*b*), then to slide and rotate the cover plate 9 inwardly and upwardly in the pocket 11, e.g. to a position 5 cm inwards and 5 cm upwards of its original location. This allows a user to introduce his/her fingers through the aperture and into the space in the pocket behind the outer skin 4 and above the aperture 3 (FIG. 4*d*).

A latch release handle 15 is mounted on the inside surface of the door panel 4 to release the door latch 23. The latch release handle 15 may be formed from any suitable material, indeed, owing to the fact that it is housed within the pocket 11, not open to the elements, materials that are generally unsuitable for use as outer door handles, e.g. leather or other more delicate materials may be used. In this particular embodiment, the latch release handle 15 comprises a knurled metal bar having a generally curved cross section and extending across the length of the aperture 3. Its primary dimensions are a depth of 25 mm and a height of 35 mm. As an alternative, the latch release handle 15 could be formed from alternative materials such as transparent/translucent plastic, or glass to illuminate through instead of, or in conjunction with a lamp assembly 17; and may have alternative textures on its surface, such as indentations to match the fingers of a user.

The latch release handle 15 is mounted for lateral movement towards and away from the inner surface of the door panel 4, and biased away from the inner surface, such that it can be pulled towards the inner surface of the door panel 4 so as to release tension on a Bowden cable 16 and manually release a door latch 23. The latch release handle 15 is coupled to a touch-switch 18, such as a capacitance sensor. Alternatively, it may abut a microswitch or the like. The capacitance sensor is connected to a door control unit (DCU) 24, so as to provide an electronic open-signal to an E-latch 23 to unlatch the door 2 and allow it to be pulled open.

The DCU 24 additionally provides the signal to operate the motor 22 to retract the cover plate 9. The signal may correspond with an unlock signal, and may be provided as a result of conventional unlock inputs, for example based on operation of a remote key (not shown); proximity sensing of a remote key (not shown); by a fingerprint sensor or other biometric sensor 25 provided on or near the cover plate, or elsewhere on the door handle assembly, or the vehicle; by pressing an interior unlock button (not shown); and/or by operating an interior door handle (not shown). The lock/unlock signals may be received directly by the DCU 24, or from an ECU 27.

A manual lock barrel 26 is also provided in an aperture in the secondary panel 12. Consequently, if the electronic unlock signal fails, the cover plate 9 may be manually retracted, a key inserted into the lock barrel 26, and the door 2 unlocked, to allow it to be unlatched by operation of the door release handle 15 pulling the Bowden cable 16. The lock barrel 26 is covered by a cover, formed in the same material and same colour as the surrounding secondary panel 12 so as to be relatively indistinguishable therefrom.

A lamp assembly 17 (FIGS. 4*a*-4*d*) is provided on the inner surface of the door panel 4, above the aperture 3 and between the latch release handle 15 and the door panel 4, arranged so as to illuminate the pocket 11 behind the aperture 3.

Light from the lamp assembly 17 illuminates the secondary panel 12, the outer surface of which is decorative, e.g. provided with a logo, which is illuminated by the lamp assembly 17. The lamp assembly 17 is capable of providing different coloured light (those skilled in the art will immediately understand how this can be achieved, e.g. by the use of a plurality of differently coloured LEDs, such as red and green LEDs). The DCU 24 determines what colour light is provided at what time (e.g. by illuminating predetermined LEDs (not shown)).

The DCU 24 is programmed to control the lamp assembly 17 to provide a different light effect in response to a lock signal and an unlock signal. In one embodiment, green light is provided in response to an unlock signal and red light is provided in response to a lock signal. Those skilled in the art will appreciate that other effects, such as fading, and flashing of a single colour of light could be used instead, or as well.

In consequence, in response to the unlock signal, the pocket 3 is illuminated in green, which initially, with the cover plate in the closed position, can only be seen through the small gap between the cover plate 9 and the edges of the aperture 3, but becomes more apparent as the cover plate 9 retracts. When the vehicle is locked, red light can be seen through the same gap.

In normal use, the DCU 24 receives an unlock signal (e.g. from sensor 25 or ECU 27) and controls the lamp assembly 17 to illuminate the pocket 11 with green light. A signal is also provided by the DCU 24 to actuate the motor 22 to retract the cover plate 9, such that it folds inwardly then moves upwardly and inwardly, as shown in FIGS. 4*b* and 4*c*. The user then introduces his fingers through the aperture 3 as shown in FIG. 4*d* and pulls the latch release handle 15. The touching of the latch release handle 15 is immediately sensed by the touch-switch 18, which sends a signal to the DCU 24 causing it to immediately unlatch the door 2, such that as the user pulls the latch release handle towards himself/herself, the door 2 opens.

When the door 2 is closed, the DCU 24 senses the closure of the is latch 23 and provides a signal to the motor 22 reversing its direction so as to move the cover plate 9 back to the closed position, in which its outer surface is flush with the outer surface of the surrounding door panel 4, to provide a smooth aerodynamic surface when the automobile 19 is driven.

The door 2 may be unlatched by operating a conventional interior door handle (not shown). This again causes the DCU 24 to send the "open" signal to the drive mechanism 20, causing the cover plate 9 to retract, allowing anyone outside the vehicle to insert their fingers into the aperture and assist in opening the door 2. Once the driver/passenger has exited the vehicle, a lock signal is provided from the DCU 24 in response to any conventional locking action, e.g. in response to a signal from a locking remote/key, or proximity/motion/time sensing. The lock signal from the DCU 24 causes the light assembly 17 to display a red light and the cover plate 9 to return to the closed position.

In the event of lack of power, e.g. in response to the vehicle's battery (not shown) running flat, a user may push the cover plate 9 inwards and upwards (as shown in FIGS. 4*b* and 4*c*), then insert a key into the locking barrel 26 to unlock the latch 23. With the latch 23 unlocked the user may pull the latch release handle 15 towards the door panel 4, releasing tension in the Bowden cable 16 and mechanically unlatching the door 2.

The above embodiment is described byway of example only. Many variations are possible without departing from the scope of the invention.

For example, the latch release handle may be transparent/translucent to provide a different lighting effect, and indeed other parts could be transparent/translucent, such as the cover plate 3 (or part thereof such as a decorative region, e.g. defining a logo), or the secondary panel 12 (or part thereof, such as a decorative region, e.g. defining a logo).

The invention claimed is:

1. A door handle assembly comprising:

a door panel having an outer surface and an inner surface;

an aperture being provided in the door panel; and a cover plate having an inner surface, the cover plate being arranged to close the aperture and actuable to retract inwardly, wherein a latch release handle is provided on the inner surface of the door panel, wherein the inn surface of the cover plate is arranged to fold inwardly and to slide inwardly and upwardly along a secondary panel into a cavity.

2. A door handle assembly according to claim 1 wherein the latch release handle is provided with a textured surface.

3. A door handle assembly according to claim 1 wherein there is a gap of no more than 3 mm between the periphery of the cover plate and the periphery of the aperture.

4. A door handle assembly according to claim 1 wherein a pocket is formed behind the aperture.

5. A door handle assembly according to claim 4 wherein a lock barrel is provided in the pocket.

6. A door handle assembly according to claim 4 wherein the pocket comprises a decorative surface or an illuminated decorative surface.

7. A door handle assembly according to claim 1:

wherein one or more lamps are provided to illuminate a region behind the aperture, the lamp assembly being provided between the latch release handle and the inner surface of the door panel.

8. A door handle assembly according to claim 7 wherein the one or more lamps are arranged to illuminate a gap between the cover plate and the aperture when the cover plate is in the closed position.

9. A door handle assembly according to claim 7 wherein the one or more lamps are arranged to alter the colour of the illumination in response to lock status.

10. A door handle assembly according to claim 7 wherein the latch release handle is transparent or translucent.

11. A door handle assembly according to claim 1 wherein the aperture has a height of at least 40 mm.

12. A door handle assembly according to claim 1 wherein the aperture has a width of at least 10 mm.

13. A door handle assembly according to claim 1 wherein the latch release handle is formed of metal.

14. A door handle assembly according to claim 1 wherein the latch release handle has a depth of at least 10 mm.

15. A door handle assembly according to claim 1 wherein the latch release handle has a height in the range of 15 mm to 40 mm.

16. A door comprising a door handle assembly according to claim 1.

17. An automobile comprising a door according to claim 16.

18. A door handle assembly comprising:

a door panel having an outer surface and an inner surface;

an aperture being provided in the door panel; and a cover plate having an inner surface, the cover plate being arranged to close the aperture and actuable to retract inwardly, wherein the inner surface of the cover plate is arranged to fold inwardly and to slide inwardly and upwardly along a secondary panel into a cavity, wherein a latch release handle is provided on the inner surface of the door panel, wherein the assembly is operable to retract the cover plate in response to an electronic "open" signal provided by pressing an interior unlock button, and/or by operating an interior door handle.

19. A door handle assembly comprising:

a door panel having an outer surface and an inner surface;

an aperture being provided in the door panel; and a cover plate having an inner surface, the cover plate being arranged to close the aperture and actuable to retract inwardly, wherein a latch release handle is provided on the inner surface of the door panel, wherein the inner surface of the cover plate is arranged to slide upwardly along a secondary panel into a cavity.

* * * * *